US006978519B2

(12) United States Patent
Pontaoe

(10) Patent No.: US 6,978,519 B2
(45) Date of Patent: Dec. 27, 2005

(54) DEVICE FOR ADJUSTING AND LOCKING A STRAP

(75) Inventor: John S. Pontaoe, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 39 days.

(21) Appl. No.: 10/732,831

(22) Filed: Dec. 10, 2003

(65) Prior Publication Data

US 2005/0125961 A1 Jun. 16, 2005

(51) Int. Cl.[7] ..... A44B 11/14

(52) U.S. Cl. ..... 24/170; 24/191; 24/193; 16/319; 16/332; 16/333

(58) Field of Search ..... 24/170, 191, 192, 24/193, 194–197; 16/319, 223, 227, 233, 16/259, 332–335

(56) References Cited

U.S. PATENT DOCUMENTS 3,344,486 A * 10/1967 Eveland ..... 24/194
4,114,236 A * 9/1978 Vandervort ..... 16/335

* cited by examiner

*Primary Examiner*—Jack W. Lavinder
(74) *Attorney, Agent, or Firm*—Mark W. Croll; Paul F. Donovan

(57) ABSTRACT

The present invention relates to a device for adjusting and locking a strap. The device includes a base portion, the base portion including a base having a first and a second side and a front and a back. A first sidewall extends away from the first side of the base, the first sidewall defining a window. A second sidewall extends away from the second side of the base, the second sidewall defining a further window. A door portion cooperates with the base portion, the door portion having a first and a second edge. The door portion includes a locking bar having a first and a second end, the locking bar extending between the first and second edges of the door portion. The first end of the locking bar defines a first positioning dial. The second end of the locking bar defines a second positioning dial such that in use of the device, the first positioning dial is movably located within the window. Also, the second positioning dial is movably located within the further window. The window includes a cam surface which cooperates with the first positioning dial. Additionally, the further window has a further cam surface which cooperates with the second positioning dial. The arrangement is such that in use of the device, with the strap disposed between the base and the locking bar, the strap is locked against movement relative to the device when the door portion is disposed in a locking disposition thereof relative to the base portion. The arrangement further being such that the strap is movably adjustable relative to the device when the door portion is pivoted relative to the windows to an adjusting disposition thereof.

20 Claims, 13 Drawing Sheets

DEVICE FOR ADJUSTING AND LOCKING A STRAP

FIELD OF THE INVENTION

The present invention relates to a device for adjusting and locking a strap. More particularly, the present invention relates to a device for adjusting and locking a strap so that the device is selectively maintained in an adjusting and a locking disposition thereof.

BACKGROUND OF THE INVENTION

The device of the present invention may be used for fastening a chin strap of a bicycle helmet. However, the device can be used with straps that are found in any number of different applications, such as book bags, gym bags, luggage bags, back packs and the like.

There are many known strap fastening devices which allow for adjusting the strap and then holding the strap in place once an adjustment has been made. A common problem with these known devices is that the closing or locking door can be opened to easily, thereby undesirably allowing the strap to move from its intended position. Another common problem with these known devices is that when trying to adjust the strap when the door is in an open position, the door is not adapted to stay in the open position, thereby causing adjustment of the strap to be somewhat cumbersome. The invention addresses these problems and other problems of the known devices.

SUMMARY OF THE INVENTION

The present invention relates to a device for adjusting and locking a strap. The device includes a base having a pair of spaced apart sidewalls, each having a window therein, and a door functionally connected to the base. The door includes a locking bar having a positioning dial on each end thereof. The positioning dials are movably located within the associated windows of the base. The arrangement being such that in use of the device, with the strap disposed between the base and the locking bar, the strap is locked against movement relative to the device when the door is disposed in a locking disposition thereof relative to the base; and, the arrangement further being such that the strap is movably adjustable relative to the device when the door is pivoted relative to the windows to an adjusting disposition thereof.

Thus, according to one aspect of the present invention, there is provided a device for adjusting and locking a strap so that it is selectively maintained in the locking and the adjusting dispositions thereof.

Other features and advantages of the present invention will become apparent to those skilled in the art upon review of the following detailed description, claims and drawings in which like numerals are used to designate like features.

Figure 1:
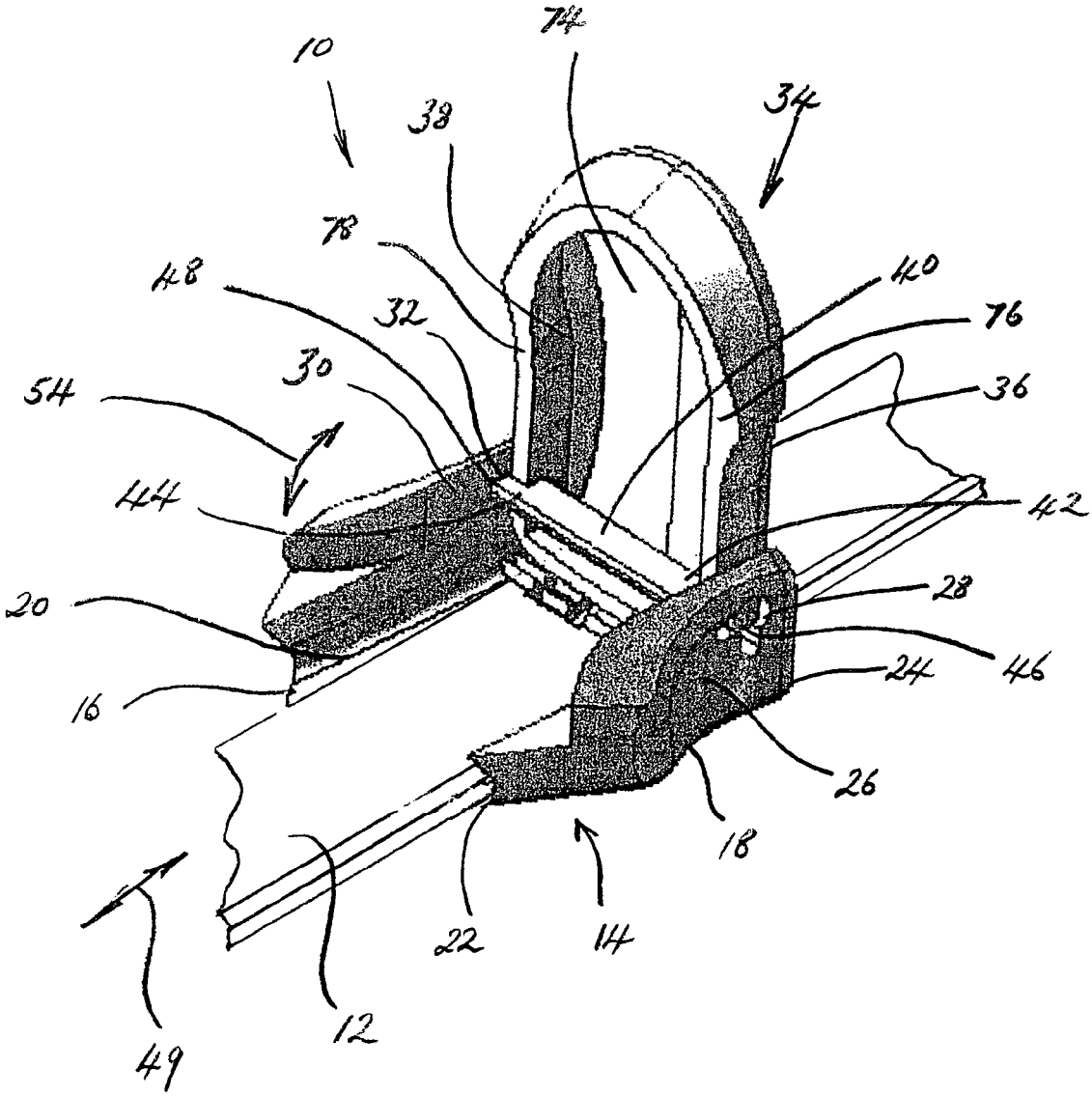
FIG. 1 is a perspective view of a device according to the present invention for selectively adjusting and locking a strap.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENT

FIG. 1 is a perspective view of a device generally designated 10 according to the present invention for selectively adjusting and locking a strap 12. The device 10 includes a base portion generally designated 14, the base portion 14 including a base 16 having a first and a second side 18 and 20 respectively and a front and a back 22 and 24 respectively. A first sidewall 26 extends away from the first side 18 of the base 16, the first sidewall 26 defining a window 28. A second sidewall 30 extends away from the second side 20 of the base 16, the second sidewall 30 defining a further window 32. A door portion generally designated 34 cooperates with the base portion 14, the door portion 34 having a first and a second edge 36 and 38 respectively. The door portion 34 includes a locking bar 40 having a first and a second end 42 and 44 respectively, the locking bar 40 extending between the first and second edges 36 and 38 of the door portion 34. The first end 42 of the locking bar 40 defines a first positioning dial 46. The second end 44 of the locking bar 40 defines a second positioning dial 48. In use of the device 10, the first positioning dial 46 is movably located within the window 28, and the second positioning dial 48 is movably located within the further window 32.

Figure 2:
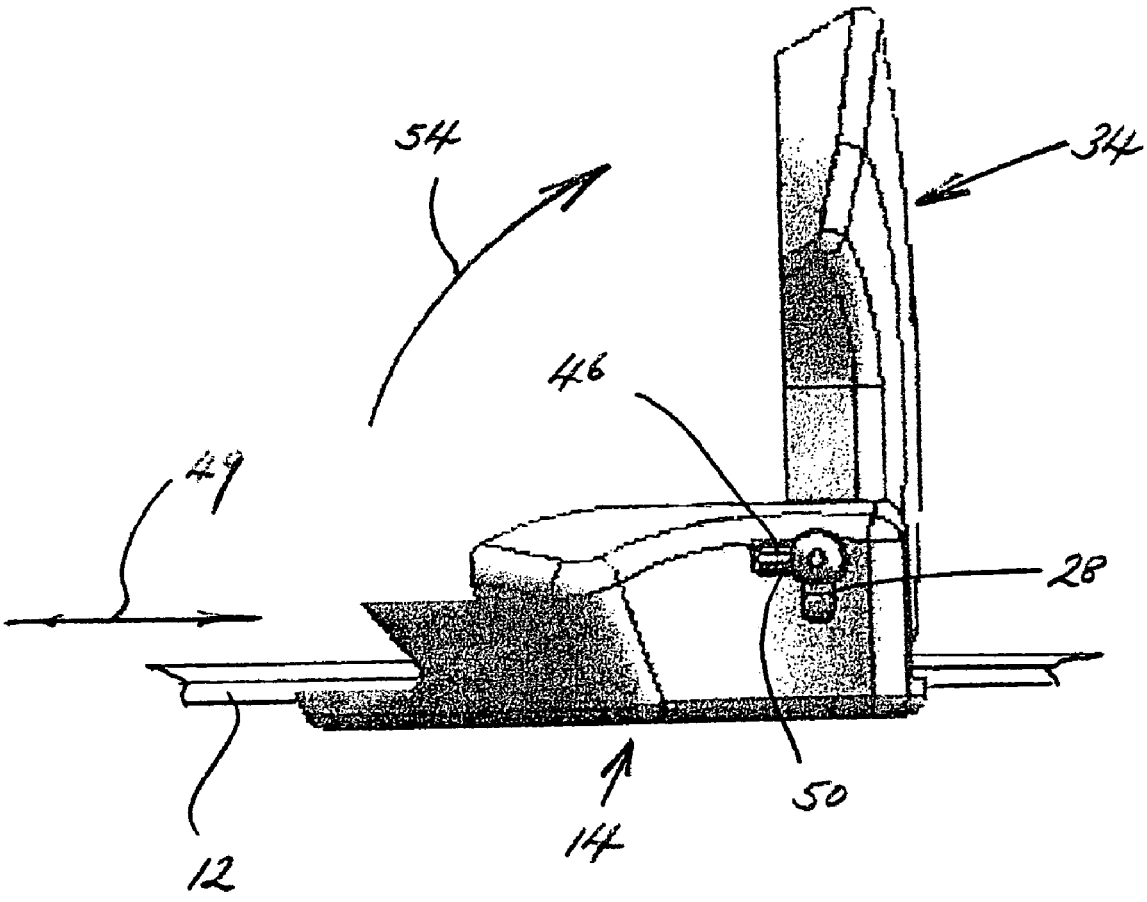
FIG. 2 is a side elevational view of the device shown in FIG. 1.

FIG. 2 is a side elevational view of the device 10 shown in FIG. 1. As shown in FIG. 2, the window 28 has a cam surface 50 which cooperates with the first positioning dial 46.

Figure 3:
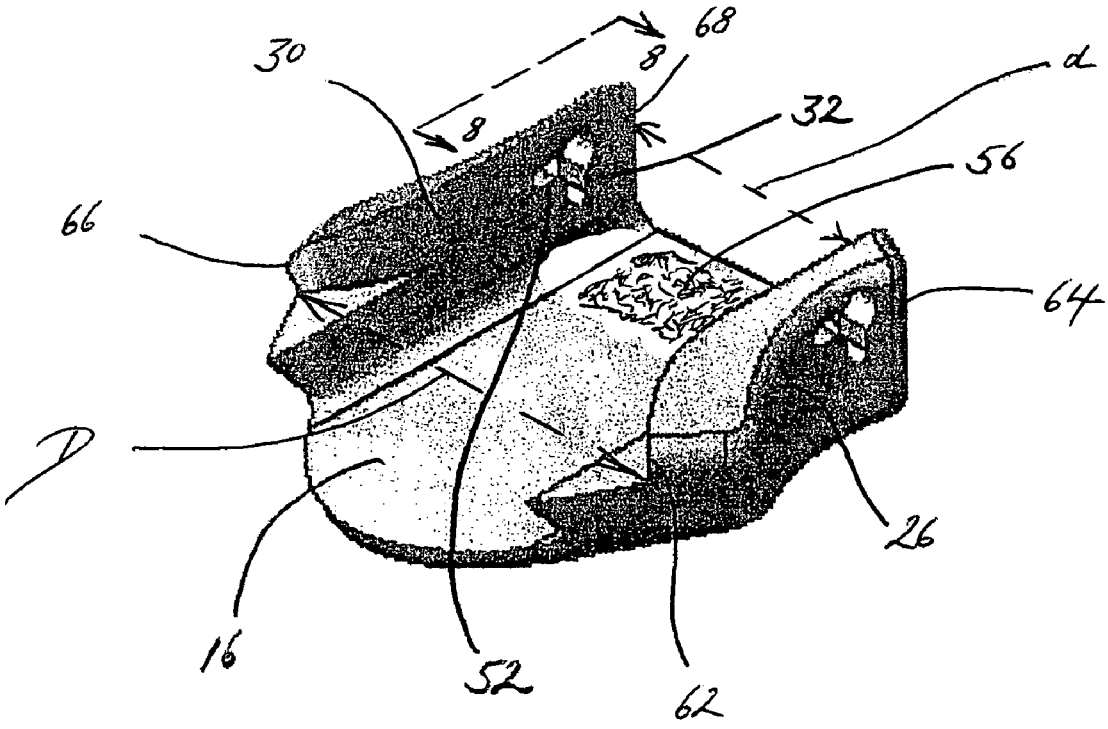
FIG. 3 is a perspective view of the base portion of the device shown in FIGS. 1 and 2.

FIG. 3 is a perspective view of the base portion 14 of the device 10 shown in FIGS. 1 and 2. As shown in FIG. 3, the further window 32 has a further cam surface 52 which cooperates with the second positioning dial 48 shown in FIG. 1.

Figure 4:
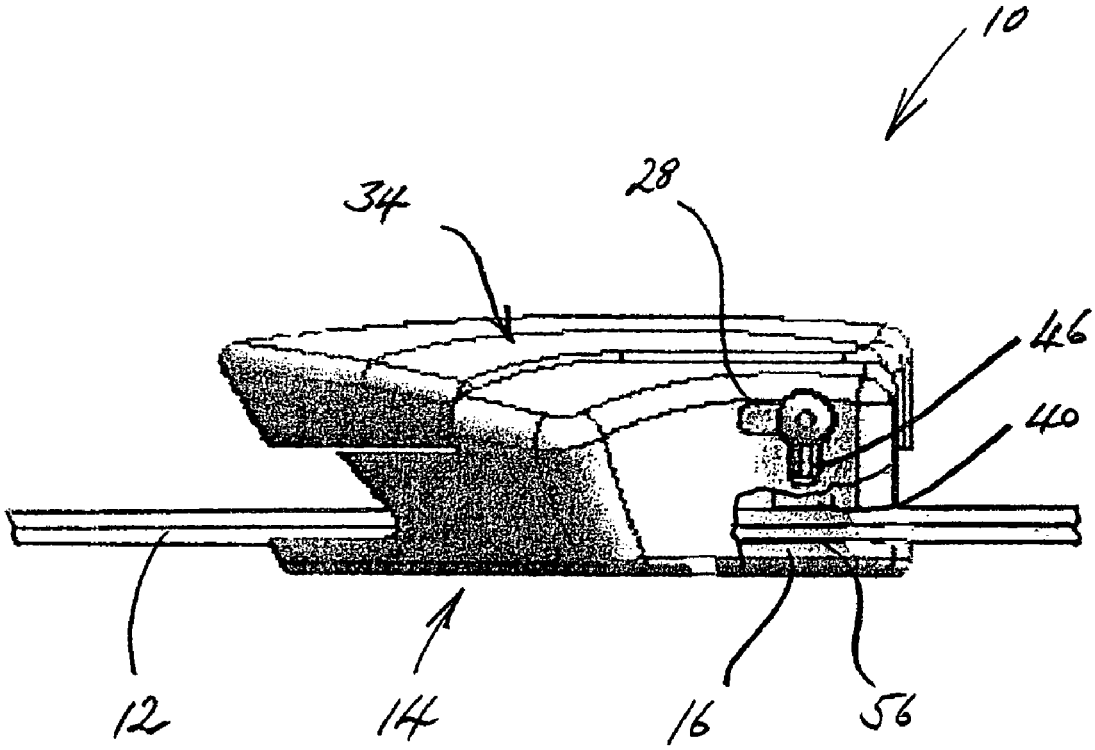
FIG. 4 is a side elevational view partially in section of the device illustrating the door portion in the locking disposition thereof.

FIG. 4 is a side elevational view partially in section of the device 10 but with the door portion 34 in the locking disposition thereof. As shown in FIG. 4, the arrangement is such that in use of the device 10, with the strap 12 disposed between the base 16 and the locking bar 40, the strap 12 is locked against movement relative to the device 10 when the door portion 34 is disposed in the locking disposition thereof relative to the base portion 14.

As shown in FIGS. 1 and 2, the strap 12 is movably adjustable relative to the device 10 as indicated by the arrow 49 when the door portion 34 is pivoted as indicated by the arrow 54 relative to the windows 28 and 32 to an adjusting disposition thereof.

In a more specific embodiment of the present invention, the base portion 14 is fabricated from a relatively flexible plastics material.

Also, as shown in FIG. 3, the base 16 defines a roughened surface 56, the roughened surface 56 reacting with the strap 12 when the door portion 34 is disposed in the locking disposition thereof as shown in FIG. 4, so that the strap 12 is locked between the roughened surface 56 and the locking bar 40 as shown in FIG. 4.

Figure 5:
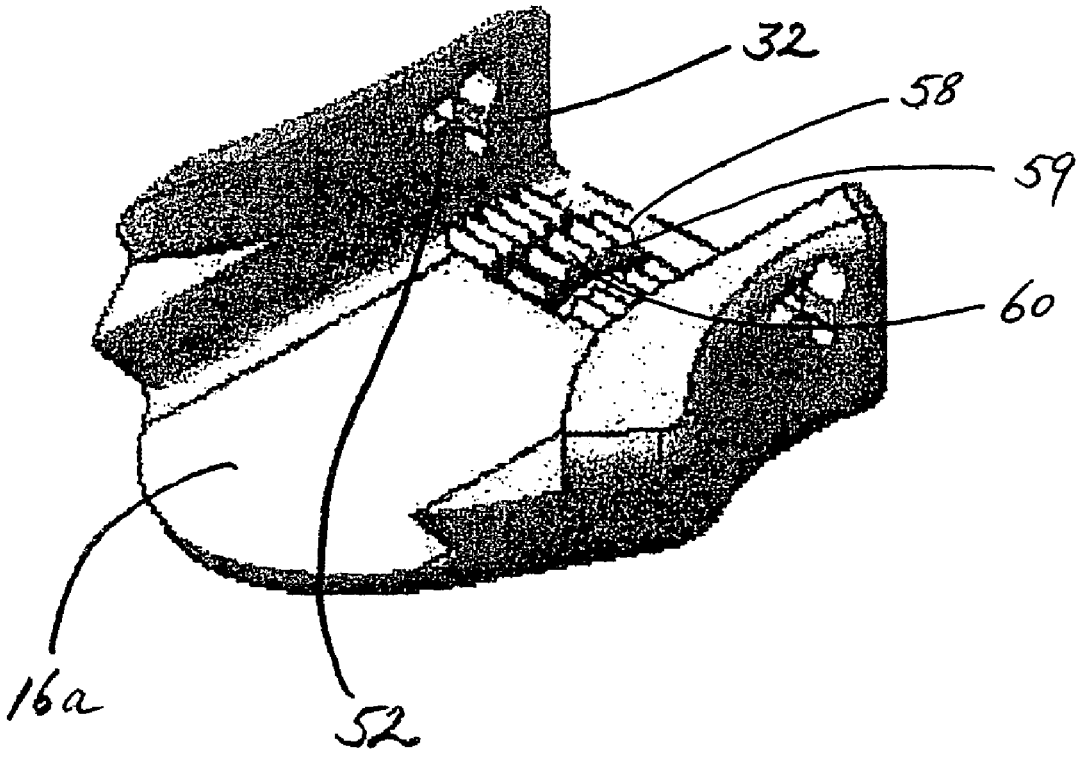
FIG. 5 is a similar view to that shown in FIG. 3 but shows another embodiment of the present invention.

FIG. 5 is a similar view to that shown in FIG. 3 but shows another embodiment of the present invention. As shown in FIG. 5, the base 16*a* defines a plurality of teeth 58, 59 and 60.

Figure 6:
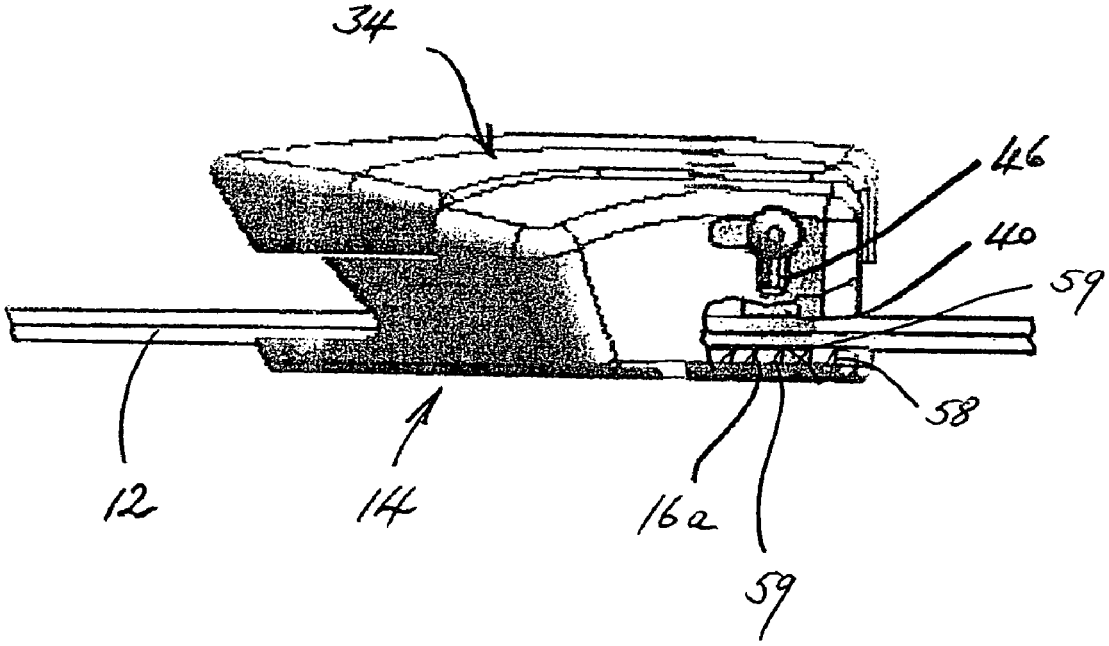
FIG. 6 is a similar view to that shown in FIG. 4 but shows the teeth shown in FIG. 5 reacting with the strap when the door portion is disposed in the locking disposition thereof.

FIG. 6 is a similar view to that shown in FIG. 4 but shows the teeth 58–60 shown in FIG. 5 reacting with the strap 12 when the door portion 34 is disposed in the locking disposition thereof so that the strap 12 is locked between the teeth 58–60 and the locking bar 40. More particularly, the plurality of teeth 58–60 are fabricated to be flexible for accommodating varying thicknesses of the strap 12. For example, the teeth 58–60 can be leaf spring elements or spring loaded elements or any other suitable configuration.

As shown in FIGS. 1 and 3, the first sidewall 26 is disposed spaced relative to the second sidewall 30.

More specifically, as shown in FIG. 3, the first sidewall 26 has a first and a second end 62 and 64 respectively. Also, the second sidewall 30 has a first and a second extremity 66 and 68. The first end 62 of the first sidewall 26 and the first extremity 66 of the second sidewall 30 are spaced a first distance D relative to each other. Additionally, the second end 64 of the first sidewall 26 and the second extremity 68 of the second sidewall 30 are spaced a second distance d relative to each other. As illustrated, the second distance d is less than the first distance D. Alternatively, D could be equal to d.

Figure 7:
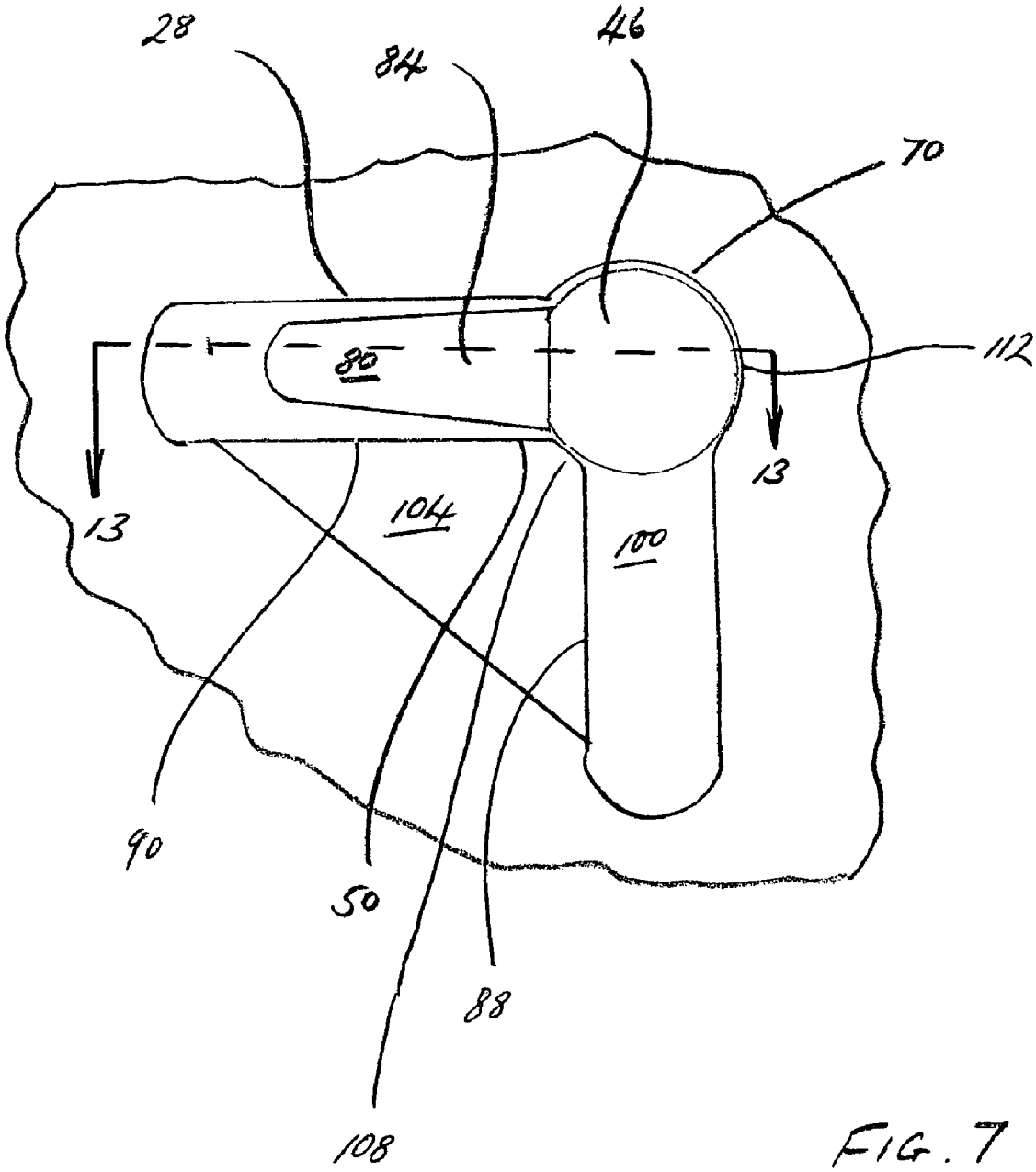
FIG. 7 is an enlarged view of the window shown in FIG. 2.

FIG. 7 is an enlarged view of the window 28 shown in FIG. 2. As shown in FIG. 7, the window 28 is of generally triangular shaped configuration. Moreover, the triangular shaped window 28 has an apex 70 which is disposed remote relative to the cam surface 50.

Figure 8:
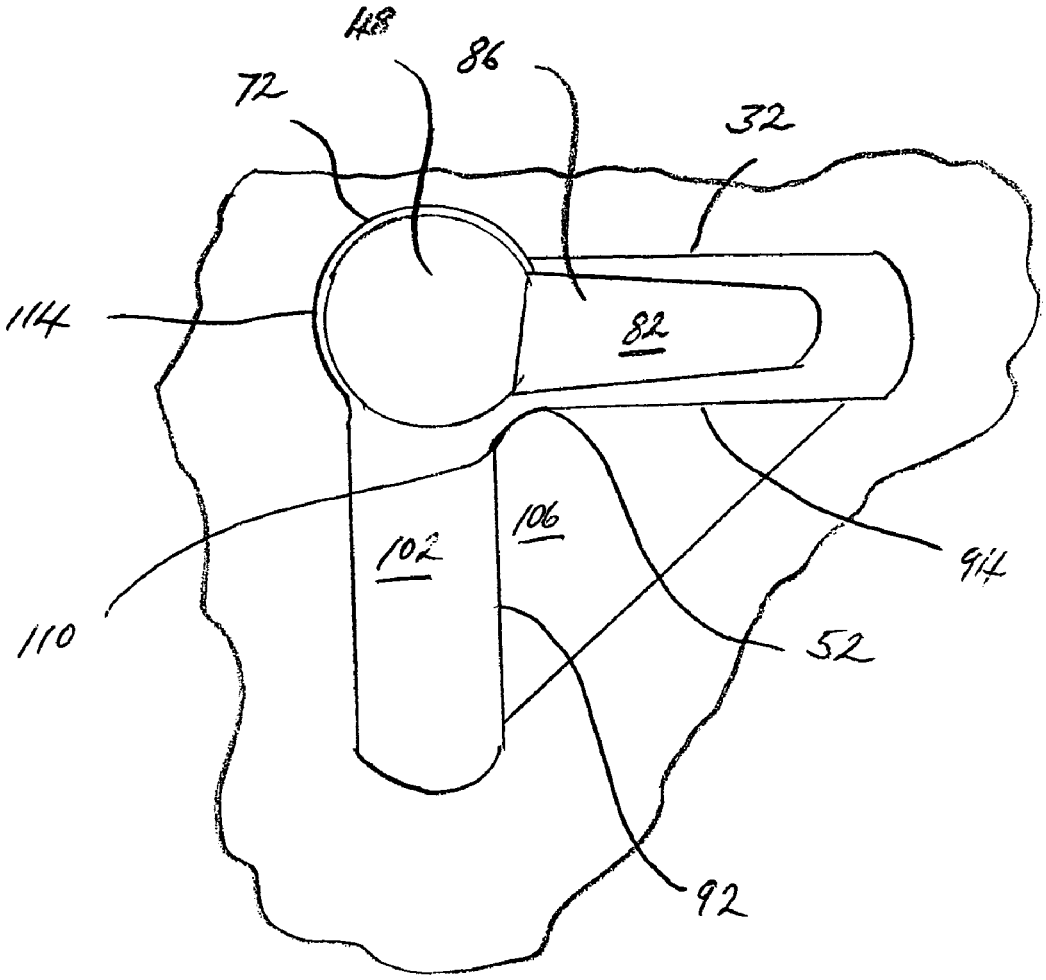
FIG. 8 is an enlarged view of the further window taken on the line 8—8 shown in FIG. 3, further illustrating the door portion in the adjusting disposition.

FIG. 8 is an enlarged view of the window 32 taken on the line 8—8 shown in FIG. 3 but with the door portion (FIG. 1) in the adjusting disposition. As shown in FIG. 8, the triangular shaped further window 32 has a further apex 72 which is disposed remote relative to the further cam surface 52. As shown in FIG. 7, the first positioning dial 46 is movably disposed between the apex 70 and the cam surface 50. Also, as shown in FIG. 8, the second positioning dial 48 is movably disposed between the further apex 72 and the further cam surface 52.

As shown in FIG. 1, the door portion 34 includes a handle 74 which extends away from the locking bar 40 and between the first and second edges 36 and 38 respectively of the door portion 34 for permitting selective pivoting of the locking bar 40 between the locking and the adjusting dispositions of the device 10 as indicated by the arrow 54.

As shown in FIG. 1, the door portion 34 includes a first and a second reinforcing rib 76 and 78 extending respectively along the first and second edges 36 and 38 of the door portion 34 for reinforcing the door portion 34.

As shown in FIG. 7, the first positioning dial 46 defines a first angled surface 80 which, in association with the surface 50, permits assembly of the first positioning dial 46 within the window 28.

As shown in FIG. 8, the second positioning dial 48 defines a second angled surface 82 which, in association with the surface 52, also permits assembly of the second positioning dial 48 within the further window 32.

Moreover, as shown in FIG. 7, the first positioning dial 46 defines a first locking rib 84 which maintains the first positioning dial 46 relative to the cam surface 50.

Figure 9:
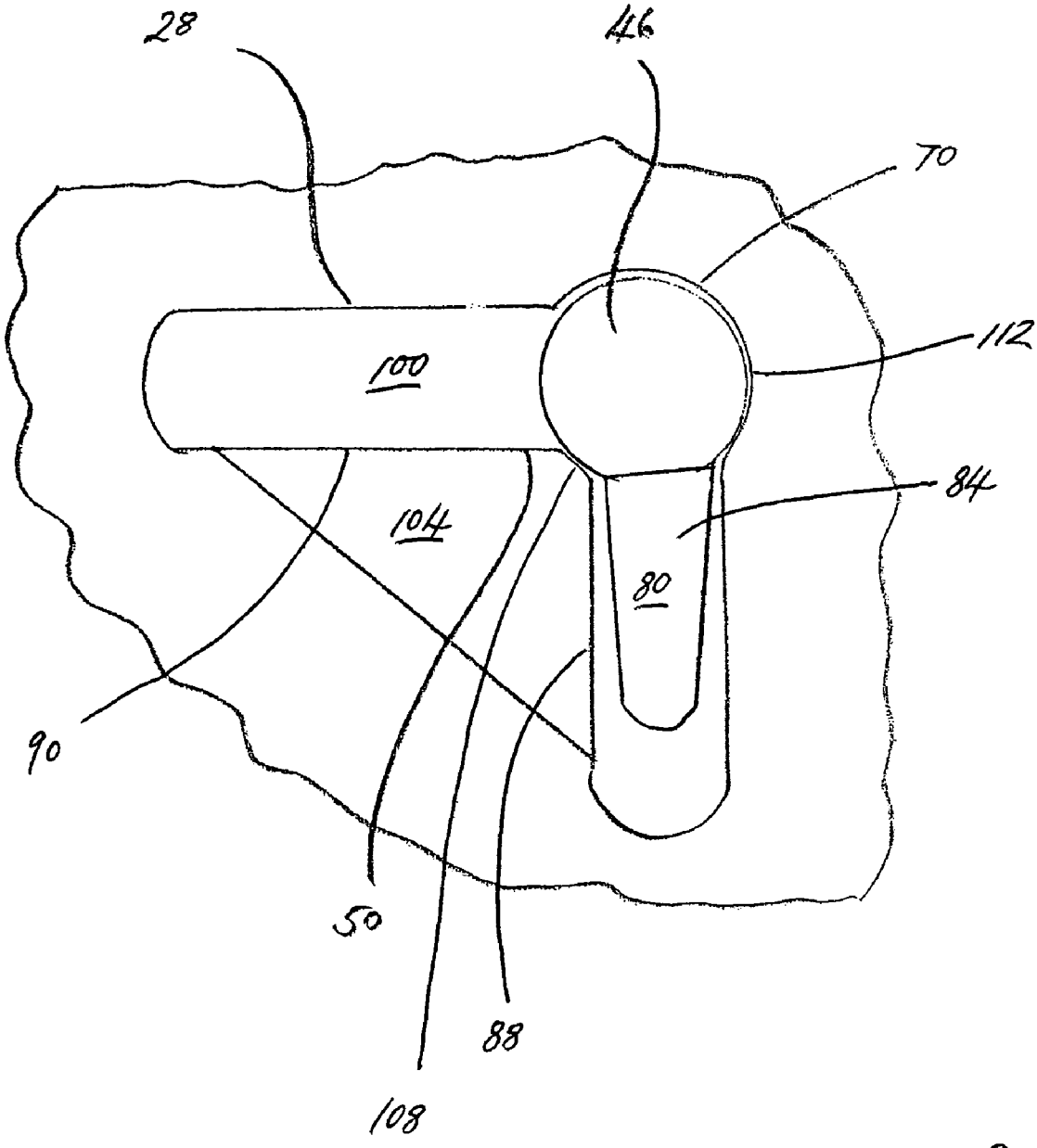
FIG. 9 is a similar view to that shown in FIG. 7 but shows the first locking rib disposed in the locking disposition.

FIG. 9 is a similar view to that shown in FIG. 7 but shows the first locking rib 84 disposed in the locking disposition whereas in FIG. 7 the first locking rib 84 is in the adjusting disposition. As shown in FIGS. 7 and 9, the arrangement is such that the device 10 is selectively maintained in the locking disposition thereof as shown in FIG. 9 for locking the strap 12 relative to the device 10 and for maintaining the first positioning dial 46 relative to the cam surface 50, and such that the device 10 is maintained in the adjusting disposition thereof as shown in FIG. 7 for adjusting the strap 12 relative to the device 10.

Figure 10:
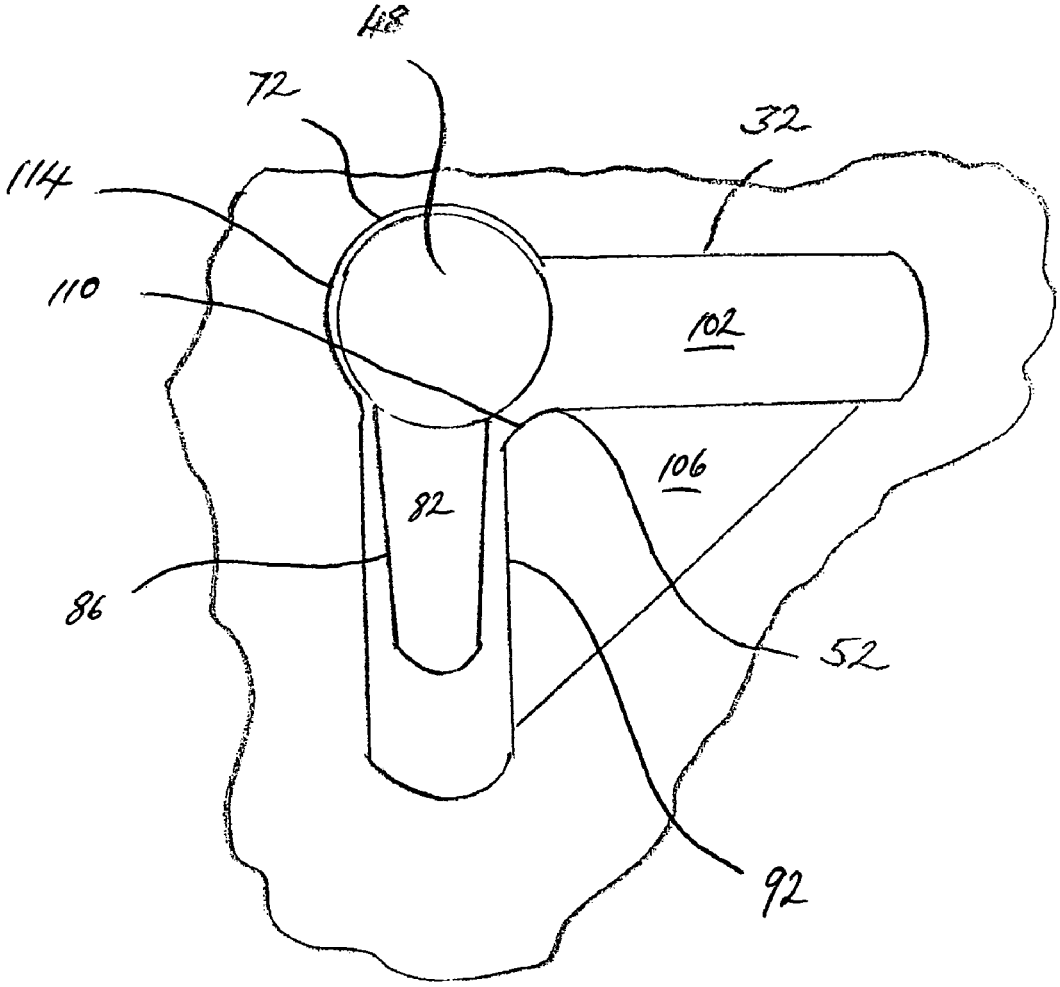
FIG. 10 is a similar view to that shown in FIG. 8 but shows the second locking rib disposed in the locking disposition.

FIG. 10 is a similar view to that shown in FIG. 8 but shows a second locking rib 86 disposed in the locking disposition whereas in FIG. 8 the second locking rib 86 maintains the second positioning dial 48 relative to the further cam surface 52. The arrangement as shown in FIG. 10 is such that the device 10 is maintained in the locking disposition thereof for locking the strap 12 relative to the device 10 and as shown in FIG. 8 for maintaining the second positioning dial 48 relative to the further cam surface 52 such that the device 10 is selectively maintained in the adjusting disposition thereof for adjusting the strap 12 relative to the device 10.

As shown in FIG. 9, the cam surface 50 includes a first portion 88 which reacts and cooperates with the first locking rib 84 for maintaining the door portion 34 in a closed disposition thereof so that the device 10 is selectively maintained in the locking disposition thereof Also, as shown in FIG. 7, a second portion 90 of the cam surface 50 is provided which reacts and cooperates with the first locking rib 84 for maintaining the door portion 34 in an open disposition thereof so that the device 10 is selectively maintained in the adjusting disposition thereof.

Additionally, as shown in FIG. 10, the further cam surface 52 includes a first member 92 which reacts and cooperates with the second locking rib 86 for selectively maintaining the door portion 34 in a closed disposition thereof so that the device 10 is in the locking disposition thereof.

As shown in FIG. 8, a second member 94 of the further cam surface 52 is provided which reacts and cooperates with the second locking rib 86 for selectively maintaining the door portion 34 in an open disposition thereof so that the device 10 is in the adjusting disposition thereof.

In the embodiments of the present invention as shown in FIGS. 1–10, the door portion 34 preferably moves approximately 90 degrees between the open and closed dispositions thereof.

Figure 11:
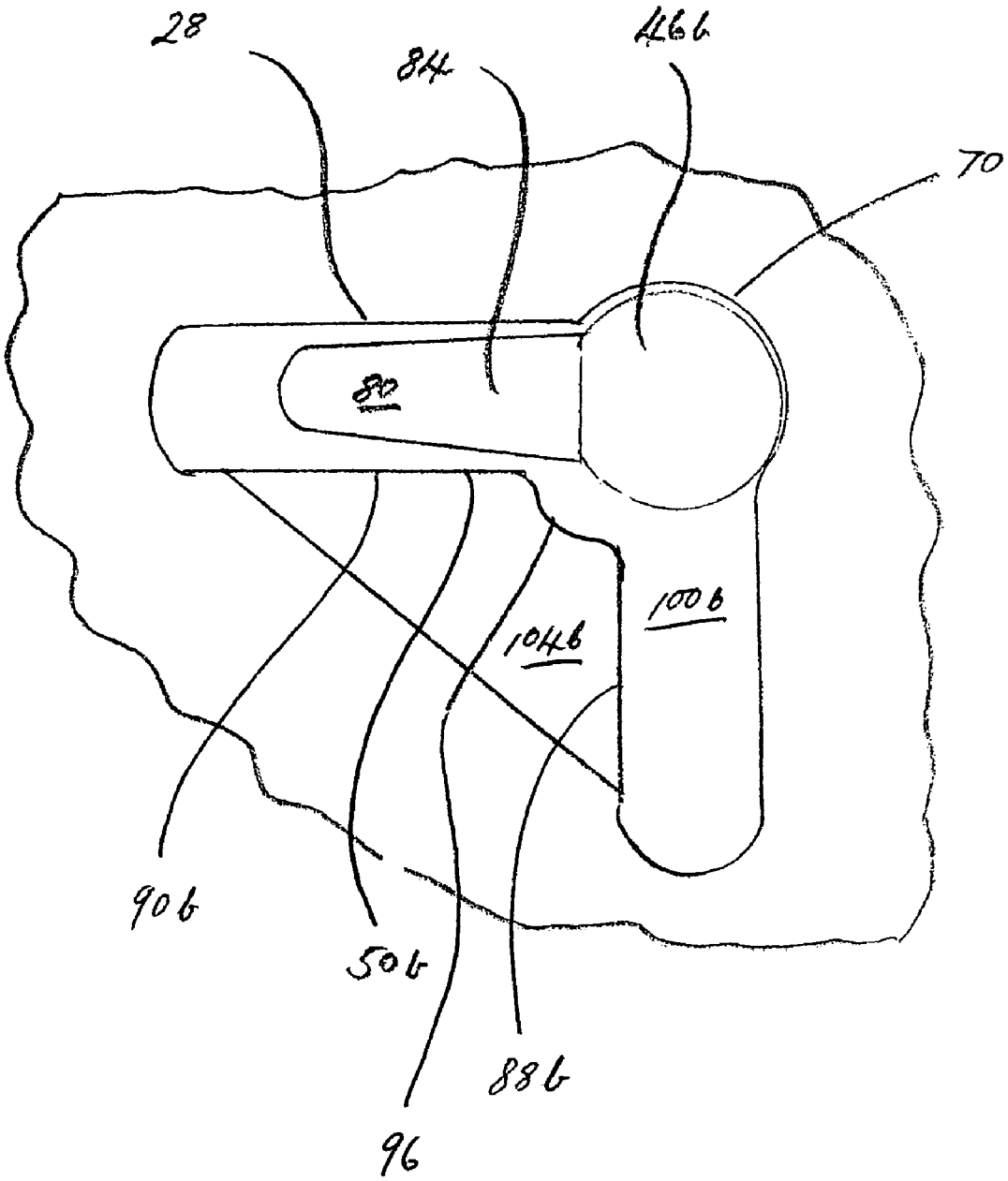
FIG. 11 is a similar view to that shown in FIG. 7 but shows another embodiment of the present invention.

FIG. 11 is a similar view to that shown in FIG. 7 but shows another embodiment of the present invention. As shown in FIG. 11, the cam surface 50*b* defines an intermediate portion 96 which is disposed between the first and second portions 88*b* and 90*b* for facilitating pivoting of the door portion 34 between the closed and open dispositions thereof.

Figure 12:
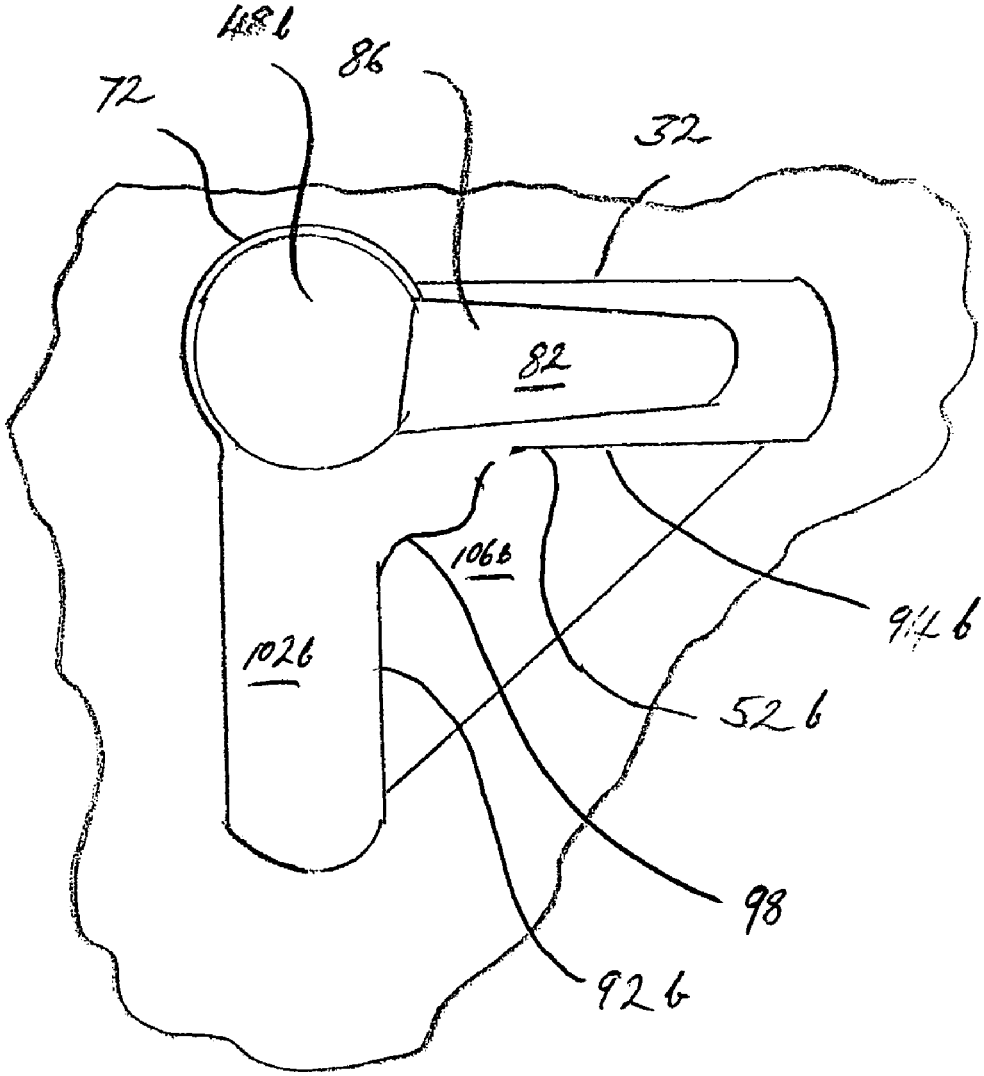
FIG. 12 is a similar view to that shown in FIG. 8 but shows the embodiment of FIG. 11.

FIG. 12 is a similar view to that shown in FIG. 8 but shows the embodiment of FIG. 1. As shown in FIG. 12, the further cam surface 52*b* defines a further intermediate member 98 which is disposed between the first and second members 92*b* and 94*b* respectively for facilitating pivoting of the door portion 34 between the closed and open dispositions thereof.

In the embodiment of the present invention as shown in FIGS. 11 and 12, the door portion 34 preferably moves approximately 100 degrees between the open and closed dispositions thereof.

As shown in FIGS. 7 and 9, the cam surface 50 is disposed within the window 28 such that an opening 100 is defined by the window 28 and the cam surface 50 for the pivotal reception therein of the first positioning dial 46.

Additionally, as shown in FIGS. 8 and 10, the further cam surface 52 is disposed within the further window 32 such that a further opening 102 is defined by the further window 32 and the further cam surface 52 for the pivotal reception therein of the second positioning dial 48.

In a preferred embodiment of the present invention, the device 10 is used for locking and adjusting a strap 12 of a bicycle helmet.

Figure 13:
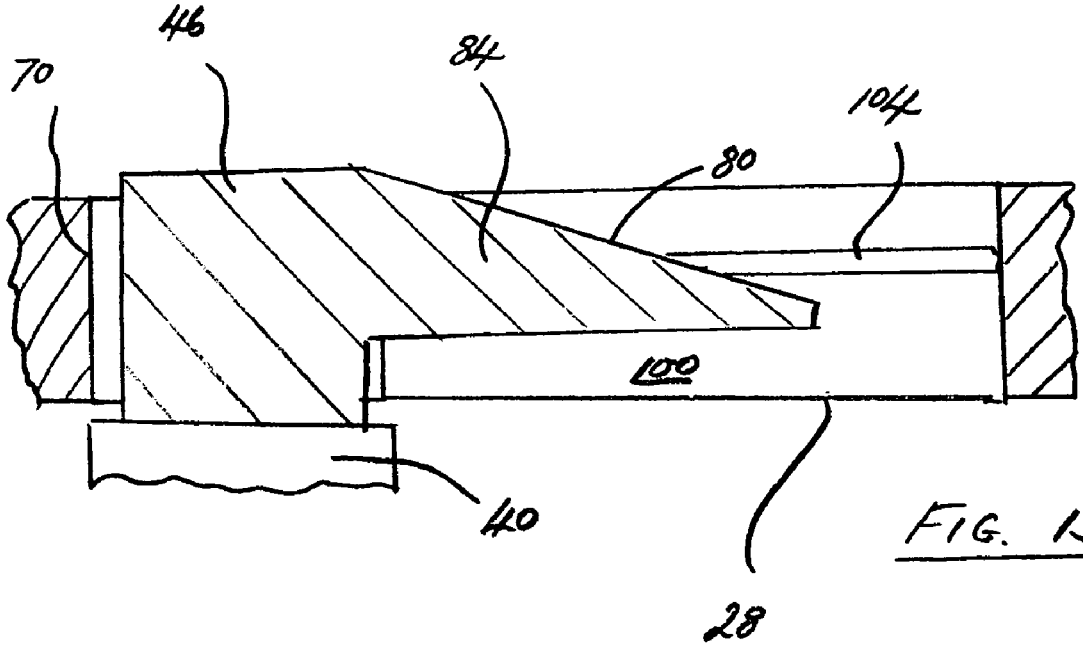
FIG. 13 is a sectional view taken on the line 13—13 of FIG. 7.

FIG. 13 is a sectional view taken on the line 13—13 of FIG. 7. As shown in FIG. 13, the first locking rib 84 has a first angled surface 80 in order to assist in the snap assembly of the door portion 34 within the window 28. Also, the second locking rib 86 is also provided with the angled surface 82 for the same purpose. The angled surfaces 80 and 82 further enable the movement of the respective positioning dials 46 and 48.

In operation of the device, the device may be used for fastening a chin strap of a bicycle helmet. However, the device can be used with straps that are found in any number of different applications, such as book bags, gym bags, luggage bags, back packs and the like.

To reiterate, there are many known strap fastening devices which allow for adjusting the strap and then holding the strap in place once an adjustment has been made. A common problem with these known devices is that the door can be opened to easily, thereby undesirably allowing the strap to move from its intended position. Another common problem with these known devices is that when trying to adjust the strap when the door is in an open position, the door is not adapted to stay in the open position, thereby causing adjustment of the strap to be somewhat cumbersome. The invention addresses these problems and other problems of the known devices.

More specifically, each embodiment includes a base portion 14 and a door portion 34. The door portion 34 is adapted to be snap fitted into the base portion 14. With reference to the first embodiment, the base portion 14 is provided with a pair of multi-positioning window openings 100 and 102 respectively, one being located opposite the other on opposing sidewalls 26 and 30 of the base 16 of the base portion 14. Located in each opening 100 and 102 is cam surface 50 and 52 respectively, which, in the first embodiment as shown in FIGS. 7–10, generally takes the shape of a triangle. The wall 104 shown in FIGS. 7 and 9 and the further wall 106 shown in FIGS. 8 and 10 respectively define the cam surfaces 50 and 52 respectively and are flexible. Opposite the apex 108 and 110 of each cam surface 50 and 52 respectively as shown in FIGS. 7 and 8, is a socket portion 112 and 114 respectively formed by the associated opening 100 and 102 respectively. The socket portions 112 and 114 are provided for the rotatable reception therein of the respective positioning dials 46 and 48. The door portion 34 is provided with the pair of positioning dials 46 and 48, one on each side of the door portion 34. The angled surfaces 80 and 82 are provided to enhance assembly of the door portion 34 to the base portion 14 and selective movement of the positioning dials 46 and 48. Extending from each positioning dial 46 and 48 are the locking ribs 84 and 86 respectively. Upon assembly, each positioning dial 46 and 48 mates with the associated opening 100 and 102 for movement therein. In the open position, each rib 84 and 86 is positioned between the second portion 90 and the second member 94 of the associated cam surface 50 and 52 and a surface defining the opening 100 and 102 in the sidewall of the base portion 14. In this way, the door portion 34 will remain open when it is desirable to adjust the strap 12. In other words, the door portion 34 will not close absent a force being applied thereto. When closing the door portion 34, the locking ribs 84 and 86 are caused to engage the triangular shaped walls 104 and 106 defining the cam surfaces 50 and 52. The flexible nature of the walls 104 and 106 allows the locking ribs 84 and 86 to move from an adjusting position to locking position. The flexible walls 104 and 106 act like a spring for urging the locking ribs 84 and 86 into the desired position (i.e. open or closed).

In the locking position, as shown in FIGS. 9 and 10, each locking rib 84 and 86 is positioned between the first portion 88 and first member 92 of the associated cam surface and another surface defining the respective opening 100 and 102. In this way, the door portion 34 will remain closed until a force is applied thereto to open the door portion 34. The door portion 34 is further provided with strengthening ribs 76 and 78 shown in FIG. 1, for strengthening the handle 74. The bottom surface of the base 16 is provided with the roughened or toothed surface to provide a further strap holding means. In one embodiment, the teeth 58–60 can be configured and adapted to flex to better accommodate straps 12 of varying thicknesses.

The second embodiment shown in FIGS. 11 and 12 is functionally quite similar to the first embodiment. The cam surfaces 50*b* and 52*b* of the flexible walls 104*b* and 106*b* are curved as compared to coming to a point or a somewhat rounded point as shown in the other embodiments. These curved surfaces 96 and 98 allow for a stronger or "beefed-up" positioning dial 46*b* and 48*b* respectively for providing more strength and stability, and to allow the positioning dials 46*b* and 48*b* to rotate within the openings 100*b* and 102*b*. Moreover, in regards to movement of the door portion 34, the door portion 34 is generally adapted to move about 90 degrees between the open and closed positions in the embodiments shown in FIGS. 1–10 and 13 and about 100 degrees or so in the second embodiment shown in FIGS. 11 and 12. Although the multi-positioning window openings have been described as accommodating two positions (open and closed), the openings 100 and 102 and associated cam surfaces 50 and 52 can be adapted and configured to accommodate multiple positions.

With reference to a bike helmet, each device holds two straps coming up from a chin strap, one strap being aligned on top of the other. In the closed position, the device holds the straps and allow the straps to continue upward to diverge around the ears of the user and then separately around the shell of the helmet.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A device for adjusting and locking a strap, said device comprising:

a base portion, said base portion including a base having a first and a second side and a front and a back, a first sidewall extending away from said first side of said base, said first sidewall defining a window, a second sidewall extending away from said second side of said base, said second sidewall defining a further window; and a door portion cooperating with said base portion, said door portion having a first and a second edge, said door portion including a locking bar having a first and a second end, said locking bar extending between said first and second edges of said door portion, said first end of said locking bar defining a first positioning dial, said second end of said locking bar defining a second positioning dial such that in use of said device, said first positioning dial is movably located within said window and said second positioning dial is movably located within said further window; wherein said window has a cam surface which cooperates with said first positioning dial, and said further window has a further cam surface which cooperates with said second positioning dial such that in use of said device, with the strap disposed between said base and said locking bar, the strap is locked against movement relative to said device when said door portion is disposed in a locking disposition thereof relative to said base portion, and the strap is movably adjustable relative to said device when said door portion is pivoted relative to said windows to an adjusting disposition thereof; and wherein said first positioning dial defines a first locking rib, and said second positioning dial defines a second locking rib, such that said locking ribs maintain said positioning dials relative to said respective cam surfaces in such a manner that said device is selectively maintained in said locking disposition thereof for locking the strap relative to said device, and said device is selectively maintained in said adjusting disposition thereof for adjusting the strap relative to said device.

2. A device as set forth in claim 1, wherein said base defines a roughened surface, said roughened surface reacting with the strap when said door portion is disposed in said locking disposition thereof so that the strap is locked between said roughened surface and said locking bar.

3. A device as set forth in claim 1, wherein said base defines a plurality of teeth like members adapted to react with the strap when said door portion is disposed in said locking disposition thereof so that the strap is locked between said members and said locking bar, said teeth like members being of a flexible nature for accommodating varying thicknesses of the strap.

4. A device as set forth in claim 1, wherein said first sidewall has a first and a second end, said second sidewall has a first and a second extremity, said first end of said first sidewall and said first extremity of said second sidewall being spaced a first distance relative to each other, and said second end of said first sidewall and said second extremity of said second sidewall being spaced a second distance relative to each other, said second distance being less than said first distance.

5. A device as set forth in claim 1, wherein said window is of generally triangular shaped configuration, and said further window is of generally triangular shaped configuration.

6. A device as set forth in claim 5, wherein said triangular shaped window has an apex which is disposed remote relative to said cam surface, and said triangular shaped further window has a further apex which is disposed remote relative to said further cam surface, such that said first positioning dial is movably disposed between said apex and said cam surface, and such that said second positioning dial is movably disposed between said further apex and said further cam surface.

7. A device as set forth in claim 1, wherein said door portion includes a handle which extends away from said locking bar and between said first and second edges of said door portion for permitting pivoting of said locking bar between said locking and said adjusting dispositions of said device.

8. A device as set forth in claim 1, wherein said door portion includes a first and a second reinforcing rib extending respectively along said first and second edges of said door portion for reinforcing said door portion.

9. A device as set forth in claim 1, wherein said first positioning dial defines a first angled surface which permits assembly and retention of said first positioning dial within said window, and said second positioning dial defines a second angled surface which permits assembly and retention of said second positioning dial within said further window.

10. A device as set forth in claim 1, wherein said cam surface includes a first portion that reacts and cooperates with said first locking rib for maintaining said door portion in a closed disposition thereof so that said device is in said locking disposition thereof, and a second portion that reacts and cooperates with said first locking rib for maintaining said door portion in an open disposition thereof so that said device is in said adjusting disposition thereof, and wherein said further cam surface includes a first member that reacts and cooperates with said second locking rib for maintaining said door portion in a closed disposition thereof so that said device is in said locking disposition thereof, and a second member that reacts and cooperates with said second locking rib for maintaining said door portion in an open disposition thereof so that said device is in said adjusting disposition thereof.

11. A device as set forth in claim 10, wherein said door portion moves approximately 90 degrees between said open and closed dispositions thereof.

12. A device as set forth in claim 10, wherein said cam surface defines an intermediate portion which is disposed between said first and second portions for facilitating pivoting of said door portion between said closed and open dispositions thereof, and wherein said further cam surface defines a further intermediate member which is disposed between said first and second members for facilitating pivoting of said door portion between said closed and open dispositions thereof.

13. A device as set forth in claim 12, wherein said door portion moves approximately 100 degrees between said open and closed dispositions thereof.

14. A device as set forth in claim 1, wherein said cam surface is disposed within said window such that an opening is defined by said window and said cam surface for the pivotal reception therein of said first positioning dial, and wherein said further cam surface is disposed within said further window such that a further opening is defined by said further window and said further cam surface for the pivotal reception therein of said second positioning dial.

15. A device as set forth in claim 1, wherein said device is used for locking and adjusting a strap of a bicycle helmet.

16. A device for adjusting and locking a strap, said device comprising;

a base having a first sidewall and a second spaced apart sidewall, each sidewall having an opening extending therethrough;

a first, generally flexible wall located in the opening in the first sidewall, the first wall including a first camming surface, such that the first camming surface is spaced from and opposite to a first socket portion provided in the opening in the first sidewall;

a second, generally flexible wall located in the opening in the second sidewall, the second wall including a second camming surface, such that the second camming surface is spaced from and opposite to a second socket portion provided in the opening in the second sidewall; and a door operatively connected to the base, the door having a locking bar that includes a first positioning dial on one end thereof and a second positioning dial on an opposite end thereof, each positioning dial mating with the associated socket and cooperating with the respective camming surface so as to allow for pivotable movement of the door, and each positioning dial including a locking rib extending therefrom, such that in an open position, each locking rib is positioned in a first position between a surface of the associated wall and a surface of the associated sidewall so that absent an intervening force, the door will remain open thereby allowing a strap positioned between the base and the locking bar to be adjusted, and such that when the door is caused to close, the locking ribs are caused to engage the associated wall thereby causing the flexible walls to flex so as to allow the locking ribs to be moved from the first position to a second position, the flexible walls being adapted to urge the locking ribs into the second position so that once in the second position, absent another intervening force, the door will remain closed thereby locking the strap in place between the base and the locking bar, each locking rib being located between another surface of the associated wall and another surface of the associated sidewall when located in the second position.

17. A device as set forth in claim 16, wherein each positioning dial includes an angled surface to facilitate a snap-fit connection between the base and the door.

18. A device as set forth in claim 17, wherein each flexible wall has a generally triangular shape.

19. A device as set forth in claim 18, wherein each camming surface is a curved, inwardly extending surface.

20. A device for adjusting and locking a strap, said device comprising:

a base portion, said base portion including a base having a first and a second side and a front and a back, a first sidewall extending away from said first side of said base, said first sidewall defining a window, a second sidewall extending away from said second side of said base, said second sidewall defining a further window, wherein said first sidewall has a first and a second end, said second sidewall has a first and a second extremity, said first end of said first sidewall and said first extremity of said second sidewall being spaced a first distance relative to each other, and said second end of said first sidewall and said second extremity of said second sidewall being spaced a second distance relative to each other, said second distance being less than said first distance;

a door portion cooperating with said base portion, said door portion having a first and a second edge, said door portion including a locking bar having a first and a second end, said locking bar extending between said first and second edges of said door portion, said first end of said locking bar defining a first positioning dial, said second end of said locking bar defining a second positioning dial such that in use of said device, said first positioning dial is movably located within said window and said second positioning dial is movably located within said further window;

wherein said window has a cam surface which cooperates with said first positioning dial, and said further window has a further cam surface which cooperates with said second positioning dial such that in use of said device, with the strap disposed between said base and said locking bar, the strap is locked against movement relative to said device when said door portion is disposed in a locking disposition thereof relative to said base portion, and the strap is movably adjustable relative to said device when said door portion is pivoted relative to said windows to an adjusting disposition thereof.

* * * * *